US008157365B2

(12) United States Patent
Wouters et al.

(10) Patent No.: US 8,157,365 B2
(45) Date of Patent: Apr. 17, 2012

(54) INK DEGASSING FOR CIRCULATING INK SUPPLY SYSTEMS IN INK JET PRINTERS

(75) Inventors: Paul Wouters, O.L.V. Waver (BE); Werner Van De Wynckel, Wolvertem (BE)

(73) Assignee: Agfa Graphics NV, Mortsel (BE)

( * ) Notice: Subject to any disclaimer, the term of this patent is extended or adjusted under 35 U.S.C. 154(b) by 429 days.

(21) Appl. No.: 12/521,138

(22) PCT Filed: Dec. 21, 2007

(86) PCT No.: PCT/EP2007/064415

§ 371 (c)(1), (2), (4) Date: Jun. 25, 2009

(87) PCT Pub. No.: WO2008/080895

PCT Pub. Date: Jul. 10, 2008

(65) Prior Publication Data

US 2010/0039486 A1 Feb. 18, 2010

Related U.S. Application Data

(60) Provisional application No. 60/880,908, filed on Jan. 17, 2007.

(30) Foreign Application Priority Data

Dec. 28, 2006 (EP) ..... 06127283

(51) Int. Cl.
*B41J 2/19* (2006.01)
*B41J 2/18* (2006.01)

(52) U.S. Cl. ..... 347/92; 347/89

(58) Field of Classification Search ..... None
See application file for complete search history.

(56) References Cited

U.S. PATENT DOCUMENTS 5,341,162 A 8/1994 Hermanson et al.
5,936,650 A 8/1999 Ouchida et al.
6,481,836 B1 11/2002 Paroff et al.
(Continued)

FOREIGN PATENT DOCUMENTS

EP 0 823 329 A2 2/1998
(Continued)

OTHER PUBLICATIONS

Official Communication issued in International Patent Application No. PCT/EP2007/064415, mailed on Mar. 14, 2008.

*Primary Examiner* — Matthew Luu
*Assistant Examiner* — Erica Lin
(74) *Attorney, Agent, or Firm* — Keating & Bennett, LLP

(57) ABSTRACT

An ink circulation system includes a supply subtank for supplying ink to an ink jet print head and a return subtank returning the ink not ejected by the ink jet print head. A print circulation path links the supply subtank with the ink jet print head and the return subtank for providing a print flow of ink from the supply subtank to the ink jet print head, the return subtank, and back to the supply subtank. A degas circulation path links the supply subtank with a through-flow degassing unit for providing a degas flow of ink from the supply subtank to the through-flow degassing unit and back to the supply subtank. The ink circulation system improves the degassing quality of the ink supplied to the ink jet print head of a printing apparatus is provided.

26 Claims, 3 Drawing Sheets

U.S. PATENT DOCUMENTS

| | | | | |
|---|---|---|---|---|
| 7,097,287 | B2 * | 8/2006 | Nakao et al. | 347/85 |
| 2005/0140753 | A1 | 6/2005 | Tsukahara et al. | |
| 2008/0297577 | A1 * | 12/2008 | Wouters et al. | 347/89 |

FOREIGN PATENT DOCUMENTS

| | | | |
|---|---|---|---|
| EP | 0 916 502 | A2 | 5/1999 |
| EP | 916502 | A2 * | 5/1999 |
| EP | 1 232 870 | A1 | 8/2002 |
| EP | 1 361 066 | A1 | 11/2003 |
| GB | 2 077 662 | A | 12/1981 |
| GB | 2 402 908 | A | 12/2004 |
| WO | 2006/064040 | A1 | 6/2006 |
| WO | WO 2006064040 | A1 * | 6/2006 |
| WO | 2008/071609 | A1 | 6/2008 |

* cited by examiner

INK DEGASSING FOR CIRCULATING INK SUPPLY SYSTEMS IN INK JET PRINTERS

CROSS-REFERENCE TO RELATED APPLICATIONS

This application is a 371 National Stage Application of PCT/EP2007/064415, filed Dec. 21, 2007. This application claims the benefit of U.S. Provisional Application No. 60/880,908, filed Jan. 17, 2007, which is incorporated by reference herein in its entirety. In addition, this application claims the benefit of European Application No. 06127283.7, filed Dec. 28, 2006, which is also incorporated by reference herein in its entirety.

BACKGROUND OF THE INVENTION

1. Field of the Invention

The present invention relates to a droplet deposition apparatus. More specifically, the invention relates to circulating ink supply systems for use with the ink jet printing apparatus.

2. Description of the Related Art

Ink jet printing technology, due to its sheer simplicity (and its ability to dispense very small controlled droplets of ink) has found a great audience. Brochures, advertisement, fliers, business cards, labels are some application areas where this technology has been approved (applications that earlier relied on offset printing). The applications for this technology have expanded over the duration of its existence. From its beginning as a business documentation printing technology, ink jet (due to its vast appeal) has crossed over into the realm of large format printing, packaging and 3D prototyping. With the requirements within each of these industry segments becoming increasingly complex, ink jet technology has managed to keep pace and deliver on each occasion.

In traditional printing applications, ink jet printing technology is used for deposition of fine droplets of ink from minute nozzles onto a receiving medium in order to create a printed reproduction of an image. In a manufacturing environment, ink jet printing is used for microdeposition and coating in critical manufacturing processes. All of these applications have created a variety of ink jet processes and print head designs. The actuating mechanism for the development of droplets in the print head has evolved over a period of time and currently three main technologies drive ink jet printing. Ink jet print heads produce droplets either continuously or on demand. Continuous production means that the ink supply is pressurized sufficiently to create a continuous stream of ink drops exiting a nozzle. Drops are created for every possible pixel location on the recording medium since the pressurized ink supply cannot know beforehand when and where pixels will need to receive an ink drop. The many drops not needed for printing onto the recording medium (because of a 'white' pixel) are discarded in some fashion. Continuous ink jet print heads always need a gutter that can capture these discarded drops. Either the gutter drops or the print drops are deflected out of the continuous stream of drops emerging from the nozzle. The drop deflection force is usually electrostatic. 'On demand' differs from 'continuous' in that ink drops are only produced on demand by manipulating a physical process to momentarily overcome surface tension forces of the ink and emit a drop of ink or cluster of drops of ink from a nozzle. The ink supply is not sufficiently pressurized to form a continuous stream of ink drops. Instead, the ink is held in a nozzle, forming a meniscus. The ink remains in place unless some other force overcomes the surface tension forces that are inherent in the liquid. The most common approach is to suddenly raise the pressure on the ink, propelling it from the nozzle. One category of drop on demand ink jet print heads uses the physical phenomenon of electrostriction, a change in transducer dimension in response to an applied electrical field. Electrostriction is strongest in piezoelectric materials and hence these print heads are referred to as piezoelectric print heads. The very small dimensional change of piezoelectric material is harnessed over a large area to generate a volume change that is large enough to squeeze out a drop of ink from a small ink chamber. A piezoelectric print head includes a multitude of small ink chambers, arranged in an array, each having an individual nozzle and a percentage of transformable wall area to create the volume changes required to eject an ink drop from the nozzle. Another category of drop on demand ink jet print heads uses hot spot transducers, approximately the same size as an image pixel, that can be pulsed to boil a very thin sheath of liquid. The tremendous volume expansion of the liquid-to-vapour phase transition creates the same pressure pulse effect as does a huge area of piezoelectric transducer.

The present invention deals with the way ink is supplied to the ink chambers of drop on demand ink jet print heads and the conditioning of the ink for optimal operation in the ink jet print head.

In the prior art, ink circulation systems for ink jet printing apparatuses have been disclosed and have proven to be beneficial for avoiding ink deterioration while the ink is installed in the printing apparatus, e.g., due to segmentation of pigment particles. WO 2006/064040 (AGFA) 2006-06-22 disclosed such a circulating ink supply system for use with drop on demand ink jet print heads in production type printing equipment. The circulation ink supply system has a through-flow ink degassing unit mounted inline with the ink circulation, i.e., the ink flowing to the print heads also flows through the degassing unit. The inline degassing solves problems related to entrapped air in the ink supply path and problems related to rectified diffusion of insufficiently degassed ink in the ink chambers of the print head during the drop production process. An embodiment is disclosed wherein the principles of ink circulation and inline degassing are applied to an ink jet printing apparatus incorporating multiple print heads. The drawing illustrating this embodiment has been recaptured as FIG. 1 in this application. The driving force for ink circulation through the print heads and through the inline degassing unit is provided by a hydrostatic pressure difference $\Delta p$ between the free ink surface in two different ink storage tanks. A hydrostatic pressure difference is, from a practical point of view, always limited and less suitable as a process variable to control an ink flow rate. Also, the actual flow rate in a hydrostatic driven ink circulation is dependent on the flow resistance in the flow path. This flow resistance may depend on the number of print heads connected, with the total length of tubing in the ink path, etc. Therefore the ink flow rate in the ink circulation system is limited in size and limited in controllability. On the other hand, the ink flow rate is an important parameter in controlling the efficiency of the inline degassing unit. The through-flow degassing unit discussed in WO 2006/064040 (AGFA) 2006-06-22 was said to operate best with an ink flow rate through the degassing unit of at least 1000 ml/hr, which is substantially higher than the ink flow rate created from the hydrostatic pressure difference $\Delta p$ between the free ink surface in two ink storage tanks. To solve this problem, another embodiment that was disclosed includes a bypass path or shunt parallel to the main ink circulation path that serves the print head. A circulation pump creates an ink flow rate through the degassing unit that is substantially higher than the ink flow rate created from the hydrostatic pressure difference Δp. The bypass path acts as a shortcut return path for the degassed ink in excess of the ink required in the main ink circulation path. The shortcut return path therefore allows the flow rate through the degassing unit to be higher than the flow rate through the main ink circulation path, and therefore to better degas the ink circulating through the shortcut degassing circuit.

The technical problem of the prior art ink circulation and degassing system is that the main ink circulation path taps degassed ink from the shortcut degassing circuit, via controllable valves, at a low flow rate and stores the tapped ink in an intermediate storage tank before being used by the print head. The intermediate storage of ink is a potential source for re-introducing gas in the (previously degassed) ink. This process may be enhanced by the splashing of the ink in the intermediate storage tank during fast acceleration and deceleration of a traversing print head carriage on which the intermediate storage of ink may be mounted. Anyhow, every degassed ink that is exposed to air, e.g., in the intermediate storage tank, is gassed over time, e.g., during a standstill of the printing apparatus.

SUMMARY OF THE INVENTION

In view of the problems described above, preferred embodiments of the present invention improve the ink circulation and inline degassing concepts known in the art for use with an ink jet printing apparatus, and to better guarantee the quality of the degassed ink delivered to ink jet print heads.

The above-mentioned benefits are realized by providing an ink circulation system for an ink jet printing apparatus as described below.

Specific features of preferred embodiments of the invention are set out below.

A major advantage of the ink circulation system according to a preferred embodiment of the invention is that the ink flow rate through the degassing unit can be controlled independently from the ink flow rate through the ink jet print head, so as to provide optimal operating conditions for the through-flow degassing unit.

Another advantageous effect of the ink circulation system according to a preferred embodiment of the invention is that ink is degassed at the location of the intermediate storage just before being supplied to the ink jet print head.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Figure 1:
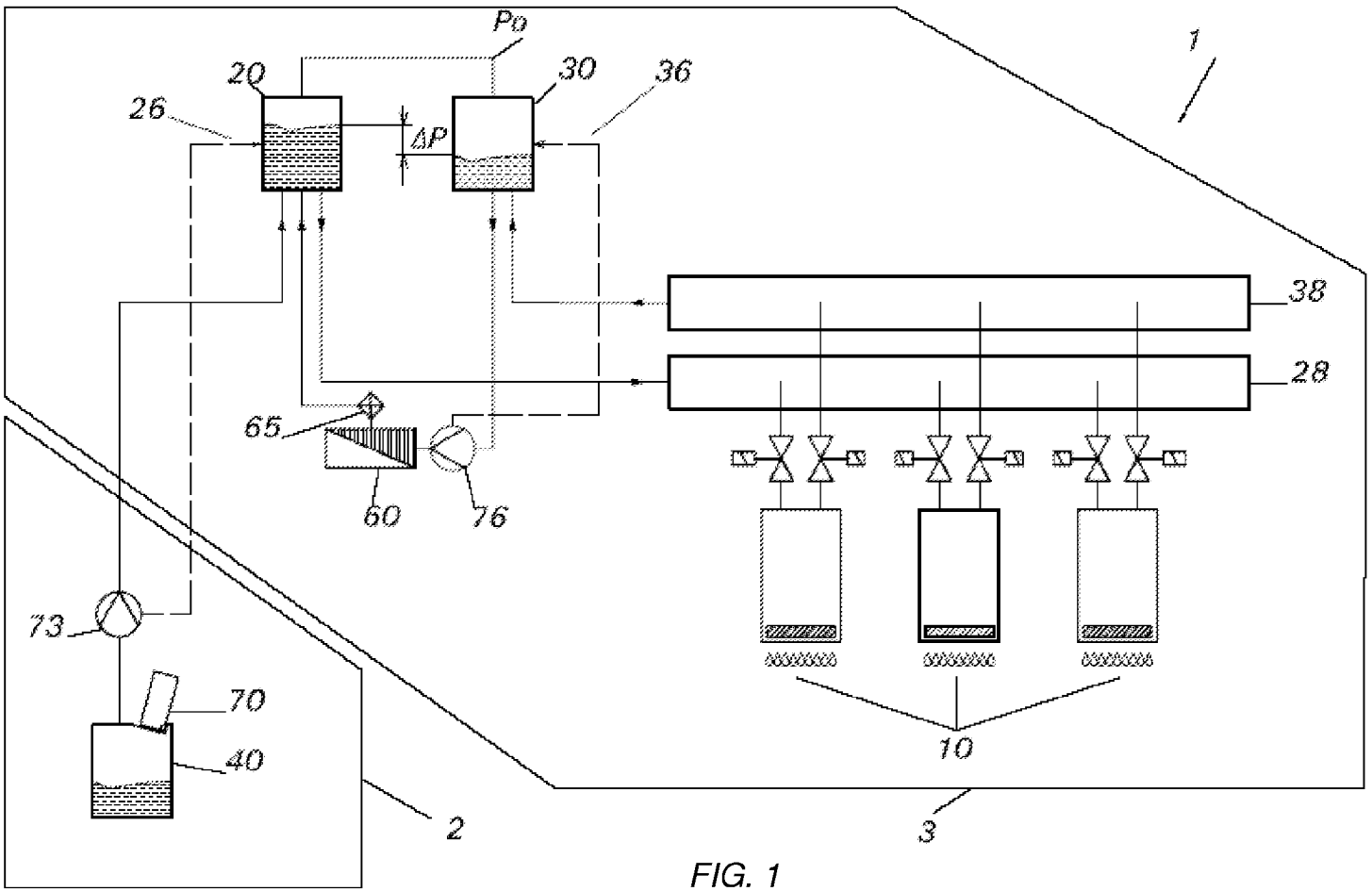
FIG. 1 PRIOR ART
FIG. 1 discloses a prior art ink circulation system with inline degassing unit in the ink flow path.

With reference to FIG. 1, an ink circulation system with inline degassing unit is described as known from the prior art. The system includes an ink supply subtank 20 for providing ink to a set of ink jet print heads 10, and an ink return subtank 30 for returning the ink not used for printing from the set of ink jet print heads 10. The supply subtank 20 and return subtank 30 are equipped with ink level sensor 26 and ink level sensor 36, respectively. Preferred embodiments of the level sensors 26 and 36 may include an ultrasonic level sensor with a switching output or analogue output as available from Hans Turck GmbH & Co (DE). The level sensors 26 and 36 may also include a set of Hall detectors arranged at the outside of the subtank, along a vertical wall, the Hall detectors being associated with a floating member having a magnet attached thereto, arranged inside the subtank. The number of Hall detectors in the set determines the degree of binary versus continuous measurement. The level sensors may be used to install a height difference between the free ink surface in supply subtank 20 and the free ink surface in return subtank 30. This height difference creates a hydrostatic pressure difference Δp that is the driving force for the ink flow through the print head, as will be explained now. The supply subtank 20 provides ink to a supply collector bar 28 that may, for example, be an extruded profile of an ink resistant material (e.g., stainless steel). The supply collector bar 28 has multiple connections to the ink inlets of the multiple print heads 10. The ink outlets of the multiple print heads 10 are connected to a return collector bar 38, which is in turn connected with the return subtank 30. The print heads 10 are connected to the collector bars 28 and 38 via actuable Open/Close valves that can cut off each individual print head 10 from the ink system. In a non-operational mode of the printer, the print heads 10 may be cut off from the ink system thereby reducing the risk for ink leakage via the nozzles of the print head, e.g., because of a loss of back pressure at the nozzles. In a purging mode, wherein ink is purged through the print heads to clear the ink chambers and the nozzles and fill the ink chambers with fresh ink, the valves may shut off those print heads 10 that do not require purging. The use of the valves thus reduces the amount of ink waste during purging. In a printing mode, the valves are Open and the multiple print heads 10 are connected with the ink supply system. The slightly negative back pressure at the nozzles of the multiple print heads 10 is then controlled via pressure $p_0$ applied at the free ink surfaces of the supply subtank 20 and the return subtank 30. The ink system is closed via an ink path from the return subtank 30 back to the supply subtank 20. This ink path includes a pump 76, degassing unit 60 and filter 65. Preferred embodiments of the pump 76 may include a liquid micro pump from KNF Neuberger or a peristaltic pump suitable for pumping ink jet inks. The degassing unit 60 may be a MiniModule hollow fibre membrane degassing unit from Membrana GmbH. The MiniModule degassing unit is connected to a variable vacuum pressure source (not shown) for controlling the degassing efficiency of the through-flow degassing unit. The filter 65 preferably is a filter that stops any clogged or gelled material in the returned ink from re-entering the supply subtank 20. A suitable filter may be a MAC type filter from Pall. A MACCA0303 may be selected for use with UV-curable inks and targeting a removal rating of 3 μm. The pump 76 is operated under control of the level sensor 36 of the return subtank 30. It pumps returned ink from the return subtank 30 back to the supply subtank 20 from where ink is withdrawn to the print heads, in order to preserve the preferred hydrostatic pressure difference Δp that drives the ink flow to the multiple print heads 10. As the hydrostatic pressure together with the pressure $p_0$ define the back pressure at the nozzles of the print head, the operating window for hydrostatic pressure variations depends on the operating window for allowable back pressure variations of the print heads 10 and may, for example, be ±5 cm equivalent hydrostatic height difference, more preferably ±1 cm equivalent hydrostatic height difference, most preferably ±0.5 cm equivalent hydrostatic height difference. The pump 76 closes the ink circulation circuit. The ink circulation circuit as depicted in FIG. 1 may be located at the carriage of an ink jet printing device. Especially industrial type ink jet printing devices where the reciprocating carriage is designed to be robust and to support multiple printing functions (e.g., print heads, ink supply systems, calibration systems, maintenance systems etc.) are suitable for carrying the ink circulation system 1 of FIG. 1. Off-axis there are located a supply vessel 40 and a pump 73 for replenishing the supply subtank 20 with fresh ink, as ink is consumed by the print heads 10. The pump 73 is operated under control of the level sensor 26 of the supply subtank 20. The use of a pump 73 allows the ink in the supply vessel 40 to be maintained at ambient pressure. The supply vessel 40 includes a docking for a main ink tank, e.g., a jerry can, that is automatically emptied when docked. The docking may, for example, provide a knife that automatically breaks a seal in the jerry can when the can is docked; the jerry can is emptied through gravity.

The prior art ink circulation system of FIG. 1 provides on-carriage (local) ink circulation and degassing, and minimal interaction between the carriage ink supply part 1 and the off-axis ink supply part 2. By design, the ink flow through the degassing unit is identical to the ink flow through the print heads. This may be a disadvantage for the optimal operation of the degassing unit 60, as the degassing may require a higher circulation flow rate than is necessary for the operation of the print heads 10 and higher than is achievable with a height difference or equivalent hydrostatic pressure difference Δp between the free ink surface of the supply subtank 20 and the return subtank 30.

Figure 2:
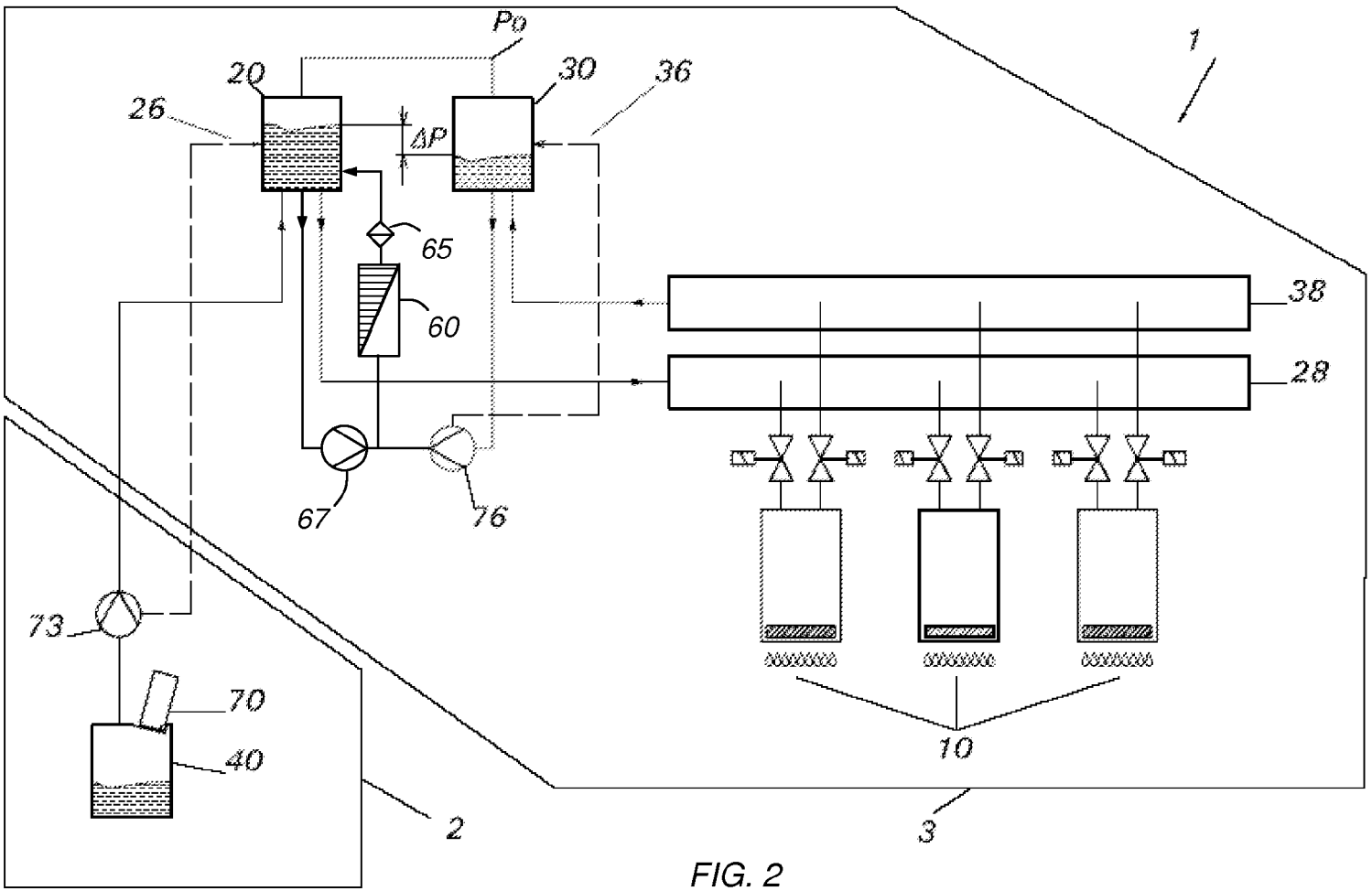
FIG. 2 shows a first embodiment of the invention using two circulation pumps to independently control a degas circulation flow and a print circulation flow.

With reference to FIG. 2, an ink circulation system according to a preferred embodiment of the invention is described with improved operation of the degassing unit. It has been shown that, for optimal operation of a through-flow degassing unit, a minimum ink flow rate through the degassing unit is preferred. This minimum flow rate is about 1000 ml/hr for the MiniModule degassing unit described above, but generally depends on the type of degassing unit. The ink circulation system depicted in FIG. 2 can provide a higher flow rate through the degassing unit than the flow rate through the print heads. This embodiment includes an ink circulation as disclosed in the prior art ink circulation system of FIG. 1, further referred to as the print circulation, and in addition an ink circulation for circulating the content of supply subtank 20 via a pump 67 past the degassing unit 60 and the filter 65 back to supply subtank 20. The latter ink circulation is further referred to as the degas circulation. The ink flow rate through the degas circulation circuit, which is controlled by pump 67, may be set to any value preferred for optimal operation and performance of the degassing unit 60 and is independent from the ink flow rate through the print circulation circuit, which is controlled by the hydrostatic pressure difference Δp and maintained by circulation pump 76. The ink flow through the print circulation circuit is merged with the ink flow through the degas circulation circuit, just before the degassing unit 60.

The advantages of a separate degas circulation of the ink in the supply subtank are multiple:

- The ink flow rate through the degassing unit can be set independent of the ink flow rate through the print heads.
- The degas circulation can be operated independent from the print circulation. The degas circulation can, for example, be started some time before the actual print circulation starts so that the ink supplied to the print heads for flushing and purging of the print head and during the printing is guaranteed to be properly degassed.
- The degas circulation operates on the content of supply subtank 20, which is the last storage of ink before it is supplied to the print heads. This is important because it has been shown that the quality of the degassed ink in supply subtank 20 of the prior art circulation system deteriorates with a standstill of the printing apparatus (because the degassing process is reversed when exposed to the air available in supply subtank 20) and also deteriorates during the shuttle movement of the carriage on which the supply subtank 20 is mounted (due to splashing of the ink content of supply subtank 20).
- Degassing is provided on-carriage thereby keeping a lean interface between the carriage ink supply system and the off-axis ink supply system.

Figure 3:
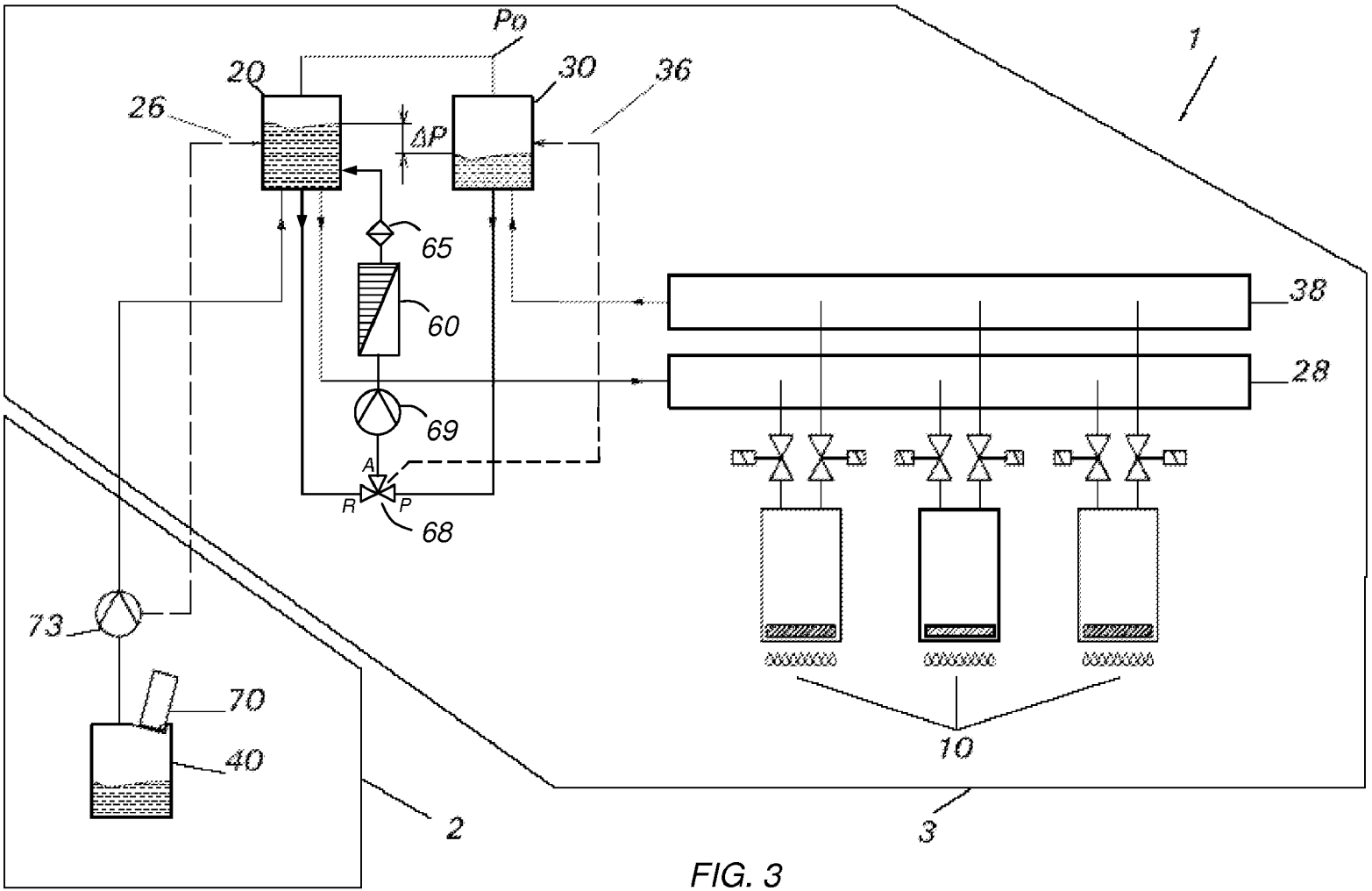
FIG. 3 shows an alternative embodiment of the invention using only one circulation pump to control the overall ink flow through the degassing unit and a 3-way valve to control the ink flow ratio between a degas circulation flow and a print circulation flow.

An alternative embodiment is shown in FIG. 3. In this embodiment, the merger of the degas circulation flow and the print circulation flow is replaced by a 3-way valve 68 and the two driving circulation pumps 67 and 76 are replaced by a single circulation pump 69. The 3-way valve 68 may be of a fast switching type wherein either port P or port R is connected with port A, or of a flow control type wherein the valve position can be controlled in intermediate positions wherein both ports P and R are partially opened and wherein the merged flow through port A is maintained constant for all valve positions. The circulation pump 69 is driven for optimal operation and performance of the degassing unit 60, i.e., preferably at a flow rate of at least 1000 ml/hr. The 3-way valve 68 is operated under control of level sensor 36 of return subtank 30, in a similar way as print circulation pump 76 was operated under control of level sensor 36. For an Open/Close type 3-way valve 68, the default operating mode may be the degas circulation port R Open, intermittently switching to the print circulation port P Open to keep the hydrostatic pressure difference Δp within the operating margins of the print circulation. For a flow control type 3-way valve 68, the default operating mode may, for example, be the degas circulation port R 91% Open and the print circulation port P 9% Open for a flow rate through the degassing unit that is about 10 times the flow rate through the print heads.

The main advantage of the alternative embodiment of the ink circulation and degassing system using the 3-way valve is cost reduction, by replacing a circulation pump by a valve.

Print Head Technology

Ink jet printing is a generic term for a number of different printing technologies that all eject drops of ink from a print head nozzle in the direction of a recording medium. Within the drop-on-demand ink jet technology we can distinguish between end-shooter type print heads, side-shooter type print heads and through-flow type print heads, depending on their design. End-shooter print heads are characterized by having the nozzles at the end of the ink chambers, while side-shooter print heads are characterized by having their nozzles at a side of the ink chambers. End-shooter and side-shooter print heads require one ink connection for providing the ink via an ink manifold to a plurality of individual ink chambers each having an actuating device arranged to ejecting a drop of ink through the nozzle associated with the ink chamber. The ink supplied to the print head is retained in the print head until it is ejected from a nozzle. Through-flow print heads on the other hand are characterized by having a continuous flow of ink through the ink chambers, i.e., ink flows via an ink inlet into a supply manifold, through a plurality of individual ink chambers, ending into a collector manifold from where the ink leaves the print head via an ink outlet. Only a small part of the ink volume that continuously flows through the ink chambers is used for ejecting ink drops from the nozzle, e.g., less than 10%. Hybrid print head designs are also known, e.g., end-shooter type print heads where the ink manifold has an ink inlet and an ink outlet. Here, the ink contained in the end-shooter ink chambers is retained in the print head until used; the ink in the ink manifold may be refreshed continuously. The present invention is independent of ink jet print head technology or print head type. Although the embodiments described above deal with through-flow or hybrid type print heads such as the UPH print head from Agfa Graphics, the invention is likewise applicable to other type of print heads. The invention includes an ink supply system based on ink circulation and not necessarily a print head based on ink circulation. For example, an end-shooter type print head may tap ink from a circulating ink flow between a supply subtank (20) and a return subtank (30).

Printer Configuration

The ink circulation and degassing system according to preferred embodiments of the invention is suitable for shuttle printer configurations as well as single pass printer configurations. In shuttle printer configurations, print heads are mounted onto a shuttling carriage which traverses across a receiving medium while printing a swath of print data. The shuttle movement is followed by a forward movement of the receiving medium in a direction orthogonal to the traversing direction of the shuttle and, during a next shuttle movement of the print head carriage across the repositioned receiving medium, printing of a next swath of print data adjacent the previous swath is performed. This type of print head setup is, for example, used in a wide range of industrial wide format ink jet printer as, for example, the :Anapurna printers from Agfa Graphics. The invention may also be used with print heads arranged in a fixed configuration across the entire printing width of the receiving medium. In this situation, the receiving medium moves with a uniform speed past a fixed set of print heads, while these print heads eject drops onto the receiving medium in accordance with print data. Printers incorporating this type of print head setup are often referred to as single pass printers. Examples of a single pass ink jet printers are the :Dotrix series of printers from Agfa Graphics. Various hybrid configurations may be thought of as well. The M-Press printer from Agfa Graphics, for example, includes a print head carriage that entirely covers the width of the receiving medium but prints non-contiguous page wide print swaths, i.e., neighbouring print swaths from neighbouring print heads do not join up tightly to form one contiguous print swath but have gaps in between. The gaps need to be filled in with a successive non-contiguous page wide print swath which interleaves the previous printed swath to create one interlaced contiguous page wide print swath. The advantage of this setup is an increased throughput compared to the more conventional shuttle printers, because of the increased width of the shuttle, without uncontrollable increase of complexity that may arise from a large amount of print heads, tubing and cabling associated with a full width contiguous page wide shuttle.

Ink Jet Inks

'Inks' used for ink jet printing processes are no longer limited to colored printing material for image reproduction, but include nowadays also structuring materials for printing of OLED displays, electronic conducting materials for printed RFID tags, adhesives materials, etc. Especially piezoelectric ink jet technology is often used for jetting a variety of liquid materials other than traditional printing inks because the physics behind piezoelectric ink jet, i.e., electrostriction, does not put constraints on the chemical composition of the liquid material to be jetted. This is not the case for thermal ink jet technology requiring a local 'evaporation' of the ink, or continuous ink jet technology requiring 'electrostatic charging' of the ink drops. From the point of view of the chemical composition of the inks, ink jet inks are often categorized in families based upon the carrier material used to carry functional particles, e.g., aqueous pigmented inks. Carrier families include aqueous inks, solvent inks, oil-based inks, radiation-curable ink (e.g., UV-curable ink), hot melt inks, and recently introduced eco-solvent and bio inks both aiming at environment friendly usage. The invention is especially suitable for inks including ink dispersions that settle easily when retained too long without stirring. A typical example is a white pigmented ink using Titanium Dioxide as the white pigment. These inks require a continuous circulation to keep the ink dispersion fit for jetting purposes.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. An ink circulation system for use in a drop on demand ink jet printing apparatus, the ink circulation system comprising:

an ink jet print head;

a supply subtank arranged to contain a supply of ink to be ejected by the ink jet print head;

a return subtank arranged to contain a return of the ink not ejected by the ink jet print head;

a print circulation path arranged to couple the supply subtank with the ink jet print head and the return subtank and arranged to provide a print flow of the ink from the supply subtank to the ink jet print head, then to the return subtank, and then back to the supply subtank;

a through-flow degassing unit arranged to degas the ink; and a degas circulation path arranged to couple the supply subtank with the through-flow degassing unit and arranged to provide a degassed flow of the ink from the supply subtank to the through-flow degassing unit and then back to the supply subtank.

2. The ink circulation system according to claim 1, wherein the print circulation path and the degas circulation path have a common path segment located directly upstream of the supply subtank, and the through-flow degassing unit is located in the common path segment.

3. The ink circulation system according to claim 1, wherein the print circulation path includes a print circulation pump, the degas circulation path includes a degas circulation pump, and the print circulation pump and the degas circulation pump are arranged to operate independently from each other for controlling a print flow rate of the ink independent from a degas flow rate of the ink.

4. The ink circulation system according to claim 2, wherein the common path segment includes a circulation pump, and a merging point of the print circulation path and the degas circulation path into the common path segment includes a 3-way valve arranged to control a flow ratio between a print flow rate of the ink and a degas flow rate of the ink.

5. The ink circulation system according to claim 3, wherein the degas flow rate is larger than the print flow rate.

6. The ink circulation system according to claim 4, wherein the degas flow rate is larger than the print flow rate.

7. The ink circulation system according to claim 3, wherein the degas flow rate is at least 1000 ml/hr.

8. The ink circulation system according to claim 4, wherein the degas flow rate is at least 1000 ml/hr.

9. The ink circulation system according to claim 5, wherein the degas flow rate is at least 1000 ml/hr.

10. The ink circulation system according to claim 6, wherein the degas flow rate is at least 1000 ml/hr.

11. The ink circulation system according to claim 1, further comprising a filter arranged between the through-flow degassing unit and the supply subtank to remove clogged or gelled material in the ink.

12. The ink circulation system according to claim 2, further comprising a filter arranged between the through-flow degassing unit and the supply subtank to remove clogged or gelled material in the ink.

13. The ink circulation system according to claim 3, further comprising a filter arranged between the through-flow degassing unit and the supply subtank to remove clogged or gelled material in the ink.

14. The ink circulation system according to claim 4, further comprising a filter arranged between the through-flow degassing unit and the supply subtank to remove clogged or gelled material in the ink.

15. The ink circulation system according to claim 1, wherein the print circulation path and the degas circulation path are supported on a carriage arranged to reciprocate across a printing medium.

16. The ink circulation system according to claim 2, wherein the print circulation path and the degas circulation path are supported on a carriage arranged to reciprocate across a printing medium.

17. The ink circulation system according to claim 3, wherein the print circulation path and the degas circulation path are supported on a carriage arranged to reciprocate across a printing medium.

18. The ink circulation system according to claim 4, wherein the print circulation path and the degas circulation path are supported on a carriage arranged to reciprocate across a printing medium.

19. A method for providing a flow of a degassed ink to an ink jet print head, the method comprising:

using an ink circulation system as defined in the claim 1.

20. A method for providing a flow a degassed ink to an ink jet print head, the method comprising:

using an ink circulation system as defined in the claim 2.

21. A method for providing a flow a degassed ink to an ink jet print head, the method comprising:

using an ink circulation system as defined in the claim 3.

22. A method for providing a flow a degassed ink to an ink jet print head, the method comprising:

using an ink circulation system as defined in the claim 4.

23. An ink jet printing apparatus comprising:

an ink circulation system as defined in claim 1.

24. An ink jet printing apparatus comprising:

an ink circulation system as defined in claim 2.

25. An ink jet printing apparatus comprising:

an ink circulation system as defined in claim 3.

26. An ink jet printing apparatus comprising:

an ink circulation system as defined in claim 4.

* * * * *